United States Patent [19]

Blackburn

[11] Patent Number: 4,985,937

[45] Date of Patent: Jan. 22, 1991

[54] BELT ASSEMBLY FOR SIZINGLY ADJUSTING THE CROTCH REGION OF A GARMENT

[75] Inventor: William A. Blackburn, Chapel Hill, N.C.

[73] Assignee: Abandaco, Inc., Manhasset, N.Y.

[21] Appl. No.: 364,847

[22] Filed: Jun. 9, 1989

[51] Int. Cl.[5] ..... A41F 9/00

[52] U.S. Cl. ..... 2/312; 2/311; 2/319; 2/308; 2/310

[58] Field of Search ..... 2/311, 312, 313, 314, 2/315, 316, 317, 318, 319, 321; 24/200, 186, 165, 169, 170, 186, 187

[56] References Cited

U.S. PATENT DOCUMENTS

| | | | |
|---|---|---|---|
| 441,732 | 12/1890 | Wilson | 24/200 |
| 1,225,254 | 5/1917 | Kaplan | 2/79 |
| 1,830,302 | 11/1931 | Townsend | 2/308 |
| 1,859,070 | 5/1932 | Borson | 2/315 |
| 1,860,727 | 5/1932 | Ansley | 2/305 |
| 3,176,793 | 4/1965 | Hilacia | 2/310 |
| 3,823,443 | 7/1974 | Takabayashi | 24/186 |
| 4,051,743 | 10/1977 | Gaylord | 24/134 |
| 4,074,364 | 2/1978 | Lucero | 2/117 |
| 4,154,183 | 5/1979 | Nunez | 112/302 |
| 4,253,198 | 5/1981 | Estabrook . | |
| 4,265,381 | 5/1981 | Muscatell | 2/312 |
| 4,799,709 | 1/1989 | Francois | 2/311 |
| 4,800,629 | 1/1989 | Ikeda | 24/200 |

FOREIGN PATENT DOCUMENTS

| | | | |
|---|---|---|---|
| 2002445 | 8/1977 | United Kingdom | 26/165 |

OTHER PUBLICATIONS

Unidentified source reference, p. 30.

*Primary Examiner*—Werner H. Schroeder
*Assistant Examiner*—G. Hale
*Attorney, Agent, or Firm*—Olive & Olive

[57] ABSTRACT

A belt assembly for sizingly adjusting the fit of a garment in the crotch region thereof. The belt assembly comprises first and second buckle closure members with an elongate belt secured thereto and forming first and second loop portions therebetween. The belt is applied to the body of a wearer with the first loop portion encircling the wearer's waist, and the second loop portion encircling the lower posterior abdomen of the wearer below the first loop portion, with the second loop portion reentrantly passing forwardly between the legs of the wearer and forwardly upwardly to a frontal proximal extremity which is fixedly secured in proximity to the matably locked buckle closure members. The belt assembly of the invention is particularly useful to sizingly adjust oversized protective garments, e.g., of the disposable type, to conformably fit the wearer.

12 Claims, 3 Drawing Sheets

BELT ASSEMBLY FOR SIZINGLY ADJUSTING THE CROTCH REGION OF A GARMENT

BACKGROUND OF THE INVENTION

1. Field of The Invention

This invention relates generally to garment articles and to a belt means for effecting adjustment of the fit of the garment article to the body of a wearer, to minimize the likelihood of tearing of seams in the crotch region of an oversized garment during movement of the wearer.

2. Description of The Related Art

In the field of protective garments, a wide variety of garment articles have been developed to protect the body against environmental contaminants, including toxins and other materials which are deleterious or undesirable in contact with, or exposure to, the body.

A specific class of garment articles which has been widely used in industry is disposable protective garments, such garments are generally of single-unit construction, serving to cover the trunk and extermities of the wearer's body. Protective garments may be of a wide variety of distinct configurations, including suits which have elasticized cuffs at the wrist and ankle regions of the suit, suits having integral hoods for protecting the wearer's head, and suits which have integral shoe-covering portions and built-in gloves.

Disposable suits of the foregoing types are formed of a wide variety of materials of construction, including paper or other cellulosic materials, thermoplastics, bonded laminants of cellulosic webs with thermoplastic films, etc.

Garments of the foregoing types are used in numerous industrial applications, including toxic waste disposal, asbestos removal from buildings, motor vehicle repair and maintenance, paint spraying, pesticide application, etc.

Although disposable garment articles are typically manufactured in a wide variety of sizes to accommodate different-sized wearers, when such articles are employed on a job site where they are used in quantity by the workforce, it has been typical practice for contracting firms and other business entities employing such suits, to purchase lots of the largest size available, and to modify same for fit on individual wearers, rather than to carry a full line of varying sizes to better fit individual wearers.

The modification of large-sized suits for this purpose typically has taken the form of taping the regions of the suit with "duct tape" on overlapped or gathered areas of the suit, so that it more closely approximates the contours of the wearer's body.

In this respect, the use of oversized suits on undersized wearers poses a specific problem with respect to the crotch region of the garments. It has been found that movement of a wearer in a oversized suit, particularly in operations such as climbing stairs, or otherwise stretching the legs and/or torso in the course of the work activities, frequently results in ripping of the garment in the crotch region.

Though this problem of crotch rip-out in disposable protective garments is to some extent alleviated by taping of the crotch area and adjacent leg and abdominal portions of the garment, to overlap or gather same for a more precise fit, such expedient in many instances produces a worse fit than the unmodified garment. In addition, the taping operation is time-consuming, and may impart an undesired rigidity to the taped area of the garment, rendering it uncomfortable and resistant to free movement of the wearer. Further, it is necessary to provide and apply tape in significant quantities for such garment modification.

U.S. Pat. No. 4,154,183 to R. M. Nunez describes a costume substructure which includes a loose-fitting garment having leg portions and a crotch portion, a set of elongated resilient vertical stays secured to the body portion of a garment in horizonally spaced position thereon, and a set of elongated resilient horizonal stays secured to the body portion of the garment in vertically spaced positions thereon, with the horizontal stays extending completely about the garment. By this arrangement, the two sets of stays are said to support the body portion of the garment in an expanded position spaced away from the body of the wearer, to simulate a creature of larger body proportions.

U.S. Pat. No. 4,253,198 describes a rescue suit for cold water exposure, which comprises a pair of arm portions and a pair of leg portions extending from the body portion. Each of the leg portions terminates in a boot portion and each of the arms terminates in a glove portion. The boot portions include material having a greater tensile strength than the remaining parts of the leg portions, and the body portion has an external surface, a first belt loop and a second belt loop extending from the external surface. The first belt loop is positioned in close proximity to the junction between the arm and body portions of the garment, and the second belt loop is positioned in close proximity to the corresponding junction between the other arm portion and the body portion. A safety belt is positioned within the belt loops to secure a rescue device.

U.S. Patent No. 4,074,364 to G. N. Lucero discloses a hold-down device for a shirt, in which an elastic hip band surrounds the hips of a wearer, and front and rear elastic fabric flaps are secured to the hip band. The flaps converge downwardly to fit the crotch of the wearer. Means are provided to attach the lower ends of the flaps together. Upwardly extending tabs are attached to the hip band at spaced intervals, with means for removably attaching the lower portion of the shirt to the tabs.

U.S. Pat. No. 1,225,254 describes a strap forming a part of a garment, extending downwardly from the upper portion of the garment body and attached to the crotch portion to prevent dropping of the crotch portion of the garment.

U.S. Pat. No. 1,860,727 discloses a garment support comprising an array of straps including a crotch strap removably attachable to a waist band at the back and removably attachable to a flap or cross band at the front.

Accordingly, it would be a substantial advance in the art to provide an effective means for adapting an oversize protective garment to the body of a wearer.

Accordingly, it is an object of the present to provide such improved means for conformably adjusting an oversize protective garment article to the body of a wearer.

It is a further object of the invention to provide such an improved means which minimizes the likelihood of crotch rip out in the use of a garment, when worn by a wearer for whom the garment article is oversized.

Other objects and advantages of the present invention will be more fully apparent from the ensuing disclosure and appended claims.

SUMMARY OF THE INVENTION

The present invention relates in one aspect to a garment size-adjustment belt assembly, comprising a first buckle closure member, a second buckle closure member matably lockable to the first buckle closure member, and an elongate belt secured to the first and second buckle closure members so as to form a first loop portion and a second loop portion therebetween.

The belt assembly is constructed and arranged so that upon matably locking the first and second buckle closure members to one another at the waist of a wearer, the first loop portion of the belt circles the waist of the wearer, and the second loop portion encircles the lower posterior abdomen of the wearer below the first loop portion and reentrantly passes forwardly between the legs and frontally upwardly to a frontal proximal extremity in proximity to the matably locked buckle closure members.

The belt assembly further comprises means for fixably securing the frontal proximal extremity of the second loop portion of the belt in associative relationship with the first loop portion of the belt.

In one embodiment, such fixably securing means comprise (i) a first mechanical coupling element on a selected one of the first and second buckle closure members, and (ii) a second mechanical coupling element associated with the frontal proximal extremity of the second loop portion of the belt, and couplingly engageable with the first mechanical coupling element.

In another embodiment, wherein the frontal proximal extremity of the second loop portion of the belt passes over a frontal buckled segment of the first loop portion of the belt, the fixably securing means comprise a slider for retaining the frontal proximal extremity of the second loop portion in position, without substantial slippage relative to the frontal buckled segment of the first loop portion.

Another aspect of the invention relates to a method for sizingly adjusting an oversize garment to the body of a wearer, by means of a protective garment crotch size adjustment belt of the type described hereinabove.

Still further aspects and features of the invention will be more fully apparent from the ensuing disclosure and appended claims.

DETAILED DESCRIPTION OF THE INVENTION, AND PREFERRED EMBODIMENTS THEREOF

Figure 1:
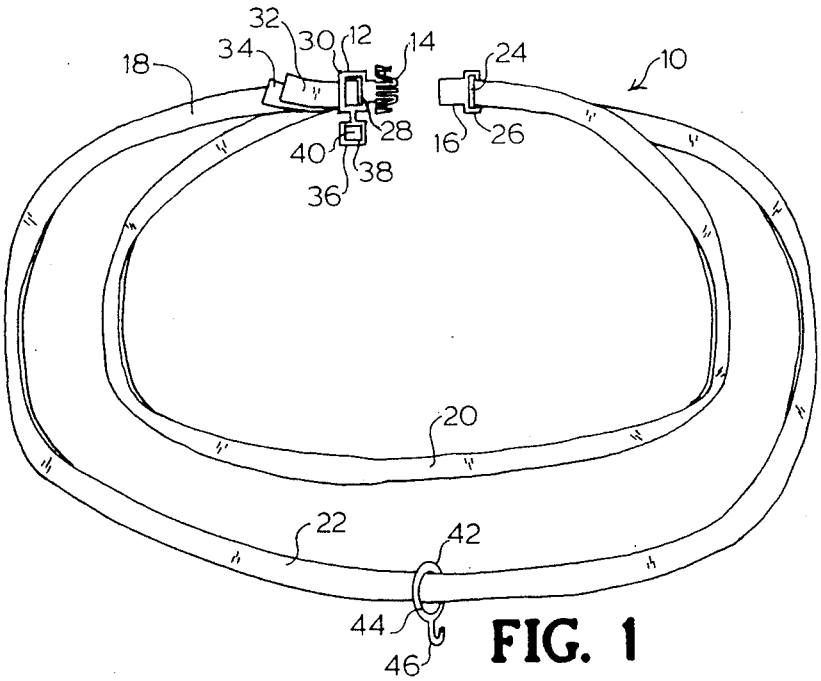
FIG. 1 is a perspective view of a crotch size adjustment belt assembly according to one embodiment of the invention.

Referring now to the drawings, FIG. 1 shows a perspective view of a garment crotch size adjustment belt assembly 10, such as may be used to appropriately size the crotch region of an oversized garment to the body of a wearer.

The belt assembly of the invention is particularly suited to crotch size adjustment of protective garments such as those employed in paint shops, asbestos removal operations, liquid spill clean-up service, and the like, but is broadly applicable to adjustment of the sizing of the crotch region of numerous other types of garments to the wearer's body.

The illustrated belt assembly 10 comprises a first buckle closure member 12, featuring male locking structure 14 for lockingly mating with a second buckle closure member 16.

Associated with the respective buckle closure members 12 and 16 is an elongate belt 18, secured to the first and second buckle closure members 12 and 16 so as to form a first loop portion 20 and a second loop portion 22 therebetween.

Preferably, the respective loops 20 and 22 consititute respective sections of a single continuous longitudinally extending belt web, as illustrated. In this single belt web construction, the belt web passes through the opening 24 at the outer margin 26 of second buckle closure member 16, with the respective loop portions 20 and 22 then passing at the opposite ends of the belt web jointly through opening 28 at the outer margin 30 of first buckle closure member 12.

For this purpose, first buckle closure member 12 is provided with a spindle, as hereinafter more fully described in connection with FIG. 4 hereof, about which the end sections 32 and 34 are wrapped as shown, so that these end sections comprise free ends which are arranged as illustrated in FIG. 1. In this manner, the end sections 32 and 34 of the belt web may be manually translated relative to the first buckle closure member 12, to selectively tighten or loosen the belt, as desired.

On a lower portion of the first buckle closure member 12 is provided a mechanical coupling element 36 integrally formed as a constituent part of the first buckle closure member. The mechanical coupling element comprises a frame 38 circumscribing an opening 40, to provide structure which is couplingly engageable with a second mechanical coupling element 42 reposed as shown on the second loop portion 22 of the belt.

The second mechanical coupling element 42 comprises a main body portion 44 which circumscribes and is longitudinally slidable on the second loop portion 22 of the belt 18. Joined to the main body portion 44 of this mechanical coupling element is a coupling structure comprising hook 46, which is selectively engageable with the frame 38 of the first mechanical coupling element 36, so that the hood 46 passes through aperture 40 and is mechanically coupled to the first buckle closure member 12, by the frame 38 thereof.

Figure 2:
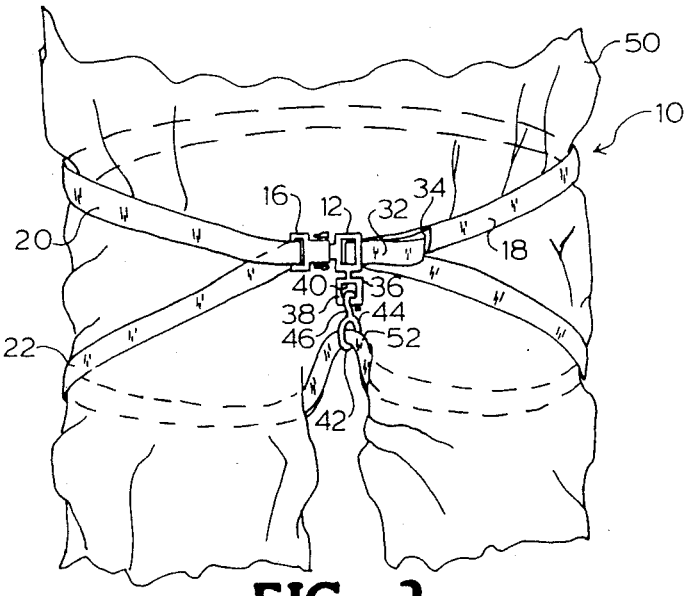
FIG. 2 is a front elevation view of the mid-section and abdominal region of a wearer of a protective garment, utilizing a crotch size adjustment belt of the type shown in FIG. 1, to sizingly adjust the garment to the wearer's body.

FIG. 2 is a front elevation view of the mid-section and abdomen of a wearer of a garment 50, the crotch region of which is sizingly adjusted to the wearer's body by means of the crotch size adjustment belt assembly 10, of the type described hereinabove with reference to FIG. 1. The size adjustment belt assembly 10 of FIG. 2 is numbered correspondingly with respect to its constituent parts and features, as in FIG. 1.

As illustrated in FIG. 2, the adjustment belt assembly 10 is constructed and arranged so that upon matably locking the first buckle closure member 12 to the second buckle closure member 16, the first loop portion 20 of the belt 18 encircles the waist of the wearer. The second loop portion 22 of the belt encircles the lower posterior abdomen of the wearer below the first loop portion and reentrantly passes forwardly between the legs of the wearer and frontally upwardly to a frontal proximal extremity 52 in proximity to the matably locked buckle closure members 12 and 16.

In this configuration, the frontal proximal extremity 52 of the second loop portion of the belt is fixably secured in relation to the first loop portion 20 of the belt, by means of the hook 46 of the second mechanical coupling element 42, which passes through aperture 40 of the first mechanical coupling element 36, so that the hook is mechanically retained on frame 38 of the first mechanical coupling element 36.

By this arrangement, the free ends of the end sections 32 and 34 of the belt 18 may be tightened or loosened against the buckle closure member 12, to appropriately size the first loop portion 20 of the belt to the waist of the wearer, and concomitantly adjust the size of the second loop portion 22 of the belt, so that the crotch region of the garment 50 is effectively gathered by the belt assembly, in a manner facilitating ready movement of the wearer of the garment, without the danger of binding or ripping of the crotch region of the garment.

By the use of the belt assembly of the invention, a single oversized garment may be readily adapted to conformably fit different sized wearers, without the disadvantage of excessive bagginess in the crotch and abdominal portions of the garment, such as otherwise may impede the free movement of a wearer, as well as occasioning ripping of the garment in the crotch region.

Figure 3:
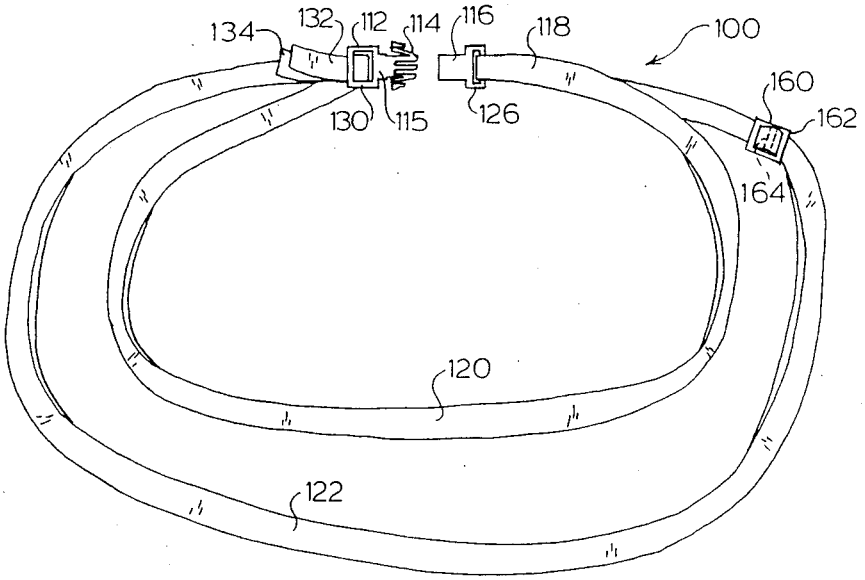
FIG. 3 is a perspective view of a crotch size adjustment belt assembly according to another embodiment of the invention.

FIG. 3 is a perspective view of a belt assembly 100 according to another embodiment of the present invention. This belt assembly includes a first buckle closure member 112, which comprises male closure structure 114 joined by yoke 115 to a frame portion 130.

The first buckle closure member 112 is matably engageable with second buckle closure member 116, to effect locking engagement of the respective buckle closure members to one another.

The second buckle closure member 116 comprises a frame portion 126 through which the belt 118 is passed, to form a first loop portion 120 and a second loop portion 122 of the belt, as shown. At its respective end segments 132 and 134, the belt is passed over a spindle in the first buckle closure member frame portion 130, as disclosed more fully hereinafter in connection with FIG. 4, so that the belt may be adjusted with respect to the sizes of loop portions 120 and/or 122, by manual translation of the free ends of the end sections 132 and 134 of the belt 118, relative to first buckle closure member 112.

In this embodiment, a slider 160 is deployed on the second loop portion 122 of the belt 118. As illustrated, the slider comprises a frame 162 defining an interior opening in which is mounted a spindle 164 over which the belt passes. The spindle 164, and/or the side portions of the frame 162 in contact with the belt, may be provided with roughened surfaces, gripping protrusions, or other structure serving to retain the slider 160 in position on the belt. The purpose of the slider in this embodiment will be more fully apparent from the ensuing description of FIGS. 5–9 hereof, relating to the use of the FIG. 3 belt assembly.

Figure 4:
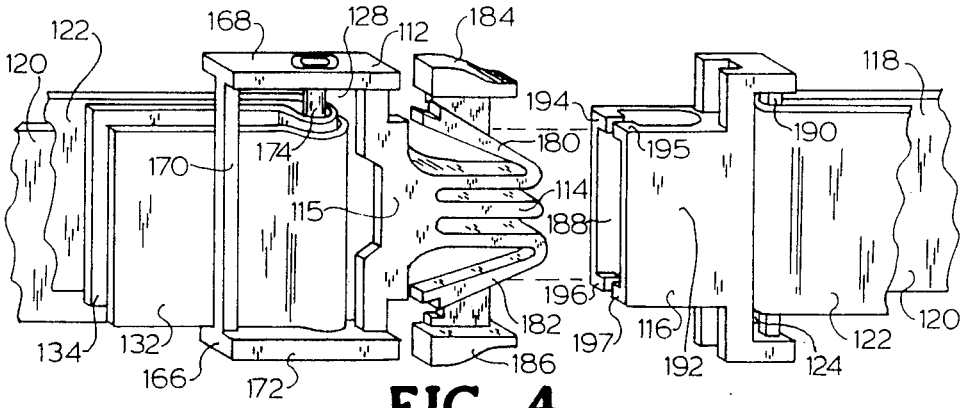
FIG. 4 is a perspective view of matably lockable buckle closure members, shown in spaced relationship to one another to illustrate the details of construction of these closure members, and associated portions of the belt.

FIG. 4 is a front perspective view of the buckle closure members of the FIG. 3 belt assembly, such buckle closure members being illustrated with associated belt portions.

The FIG. 4 buckle region of the belt assembly is also illustrative of the corresponding part of the belt assembly embodiment shown in FIG. 1, with the exception that the FIG. 4 embodiment does not employ the mechanical coupling member 36 as illustrated in FIG. 1.

The portion of the belt assembly shown in FIG. 4 comprises first buckle closure member 112 which includes locking structure 114, joined by yoke 115 to the frame 166 comprising upper flange member 168, frame edge member 170, and lower flange member 172, arranged as shown. By this arrangement, the yoke 115, flange member 168, frame edge member 170, and flange member 172 corporately bound an opening 128 in which is disposed a spindle 174 journaled at its respective ends in openings in the respective flange members.

The end sections 132 and 134 of the respective first loop portion 120 and second loop portion 122 of the belt pass around the spindle 174 as illustrated. To enhance the retention of the respective free ends of the end sections 132 and 134 of the belt, the surface of frame edge member 170 in contact with the belt may be provided with a roughened surface, retaining protrusions, or other structure serving to prevent slippage of the belt end sections relative to buckle closure member 112.

The locking structure 114 of the buckle closure member 112 is formed with marginal tine elements 180 and 182, on the extremities of which are provided finger grips 184 and 186, respectively.

The locking structure 114 of the buckle closure member 112 is formed of a suitable flexible resilient material of construction, so that when manual pressure is exerted on the finger grips 184 and 186, the tines 180 and 182 are laterally inwardly compressed to accommodate entry of the locking structure 114 into a matably configured cavity 188 of second buckle closure member 116.

The second buckle closure member 116 is formed with a spindle 190 in spaced relation to the main body portion 192 of the buckle closure member, to define an opening 124 through which belt 118, comprising first loop portion 120 and second loop portion 122, passes over the spindle 190 as shown.

Once the locking structure 114 of first buckle closure member 112 is fully inserted into cavity 188 of second buckle closure member 116, the respective buckle closure members are matably locked to one another. Subsequently, when it is desired to remove the belt from the wearer's body, or otherwise to separate buckle closure member 112 from buckle closure member 116, manual pressure again is exerted on the finger grips 184 and 186 to laterally compress the locking structure 114 so that the locking structure is disengaged from the retaining projections 194, 195, 196, and 197 bounding the opening of cavity 188.

FIGS. 5 through 9 show sequential, front elevation views of mid-section and abdominal portions of a wearer's body, during installation of the belt assembly of the type illustratively described with reference to FIGS. 3 and 4 hereof.

Figure 5:
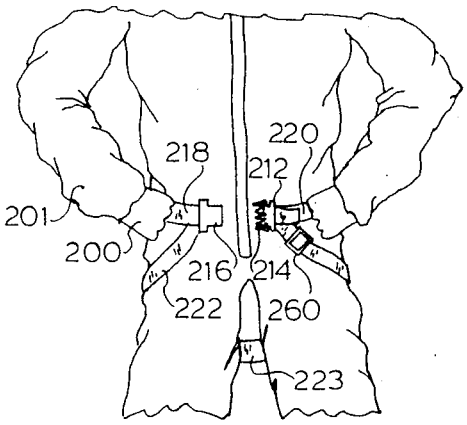
FIGS. 5–9 show sequential front elevation views of the mid-section and abdomen of a wearer of a protective garment employing a crotch size adjustment belt according to an embodiment of the present invention, illustrating steps for sizingly adjusting the crotch of the garment to the wearer's body.

With reference to FIG. 5, there is shown a wearer 200 of a protective garment 201 with a belt assembly 218 of the type illustratively shown and described with reference to FIGS. 3 and 4 hereof.

The belt assembly 218 comprises a first buckle closure member 212 featuring mating structure 214 which is lockingly matable with a second buckle closure member 216.

The belt assembly features a first loop portion 220 which is arranged to encircle the waist of a wearer. The belt assembly further comprises a second loop portion 222 encircling the lower posterior abdomen of the wearer below the first loop portion 220. The second loop portion as shown comprises lower posterior extremity 223 in the initial deployment position shown in FIG. 5. In this deployment position, the slider 260 is positioned on the second loop portion 222, in proximity to the first buckle closure member 212.

Figure 6:
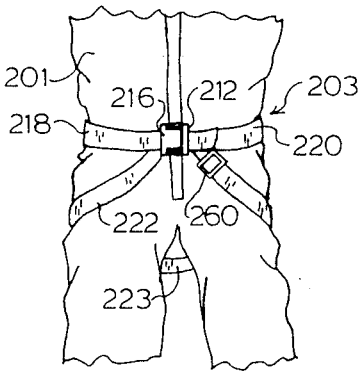
Figure 9:
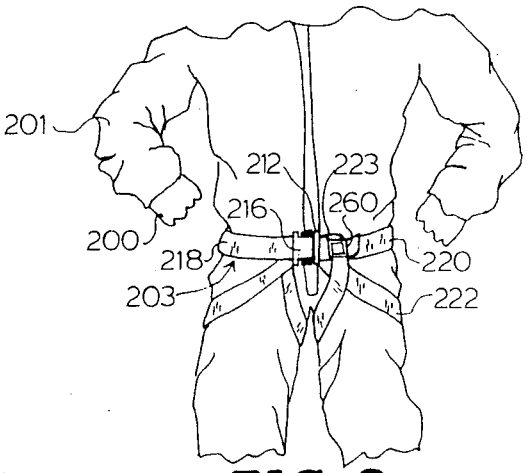

FIG. 6 shows a subsequent view of the installation of the belt assembly 203, in which the first buckle closure member 212 has been lockingly mated with the second buckle closure member 216. The belt assembly then is adjusted to the waist size of the wearer, by moving slider 260 towards the mated first and second buckle closure members 212 and 216, to secure a desired waist fit. Alternatively, if the waist fit initially obtained when the buckle closure members are locked to one another is excessively tight, the waist fit may be loosened by moving the slider 260 away from the locked first and second buckle closure members.

Figure 7:
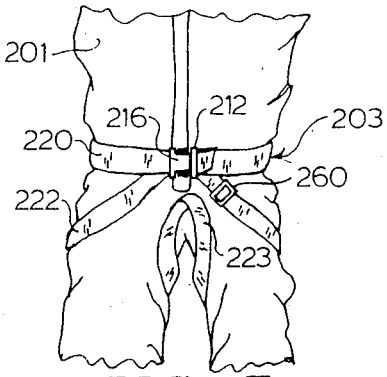

Next, as shown in FIG. 7, the lower posterior extremity 223 of the second loop portion 222 of the belt is passed forwardly between the legs of the wearer and drawn frontally upwardly to form a frontal proximal extremity, so that that prior posterior extremity 223 now becomes a frontal proximal extremity, positioned in proximity to the matably locked buckle closure elements 212 and 216.

Figure 8:
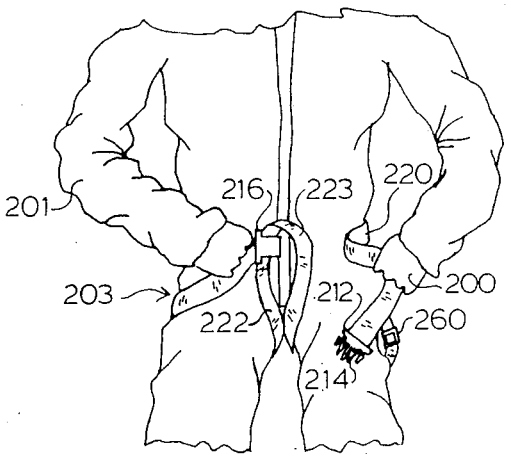

Next, as shown in FIG. 8, the matably locked buckle comprising buckle closure members 212 and 216 is opened to separate the respective buckle closure members from one another. The second buckle closure member 216 and associated belt first and second loop portions then are grasped by the right hand of the wearer as shown and the second buckle closure member 216 is inserted through the loop formed by the frontal proximal extremity 223 of the second loop portion of the belt. The belt assembly thereupon is rebuckled by lockingly engaging first buckle closure member 212 with second buckle closure member 216, and the slider 260 is manually translated from its former position to the position shown in FIG. 9, so that the slider subsequently functions to maintain the frontal proximal extremity 223 of the second loop portion 222 of the belt in fixedly secured relationship to the matably locked buckle closure member 212 and 216.

The belt assembly of the present invention, and the constituent buckle closure members, slider, and coupling element thereof, may be formed of any suitable materials of construction appropriate to the end use applications for which the belt assembly is to be employed.

Thus, the belt may be formed of any appropriate natural orsynthetic material, of a suitably flexible character, such as for example leather, fabrics, plastics, etc. In preferred practice, the belt may suitably comprise a fibrous web, which may be woven or non-woven in character; by way of example, the belt may comprise a woven polypropylene webbing.

The buckle closure members, slider, and coupling elements may be formed of materials of construction such as wood, metal, plastic, etc. When a buckle closure member structure of the type shown in FIG. 4 is employed, the mating structure 114 should be formed of a material which is of sufficient flexible resilient character to accommodate manual lateral compression of the mating structure for insertion thereof into the cavity 188 of the complementary buckle closure member 116. Satisfactory results have been achieved employing a belt assembly of the type shown in FIG. 4, wherein the respective buckle closure members are formed of polypropylene.

It will be appreciated that in the broad practice of the present invention, the means for fixedly securing the frontal proximal extremity of the second loop portion of the belt in proximity to the lockingly mated first and second buckle closure members of the belt assembly may be varied widely, it being necessary only that any such securing means effectively gather the crotch region of a garment to which it is applied, so that the crotch region of the garment is conformably adjusted to the body of a wearer.

Accordingly, while the invention has been described with regard to specific features, aspects, and embodiments, it will be appreciated that numerous other variations, modifications, and embodiments are possible, and all such variations, modifications, and embodiments therefore are to be regarded as being within the spirit and scope of the invention.

What is claimed is:

1. A belt assembly for adjusting fit of a garment in the crotch region thereof, said belt assembly comprising:
   (a) a first buckle closure member;
   (b) a second buckle closure member matably lockable to said first buckle closure member;
   (c) an elongate belt secured to said first and second buckle closure members so as to form a first loop portion and a second loop portion therebetween, said belt being constructed and arranged so that upon matably locking said first and second buckle closure members to one another at the waist of a wearer, the first loop portion encircles the waist of the wearer and the second loop portion encircles the lower posterior abdomen of the wearer below the first loop portion and reentrantly passes forwardly between the legs and frontally upwardly to a frontal proximal extremity in proximity to the matably locked buckle closure members;
   (d) means for fixably securing said frontal proximal extremity in proximity to said matably locked first and second buckle closure members.

2. A belt assembly according to claim 1, wherein said means (d) comprise:
   (1) a first mechanical coupling element on one of said first and second buckle members; and
   (2) a second mechanical coupling element associated with the frontal proximal extremity of said second loop portion of said belt, and couplingly engageable with said first mechanical coupling element.

3. A belt assembly according to claim 1, wherein said frontal proximal extremity of said second loop portion of the belt passes over a frontal buckled segment of the first loop portion of the belt, and wherein said means (d) comprise a slider for retaining the frontal proximal extremity of the second loop portion in position.

4. A belt assembly according to claim 2, wherein said first mechanical coupling element comprises a first frame secured to one of said first and second buckle closure members, said first frame circumscribing a first opening; and said second mechanical coupling element comprises a second frame circumscribing a second opening through which said second loop portion of the belt passes, with a hook secured to said second frame, constructed and arranged such that the hook is engageable with said first frame by passage of the hook through the first opening of said first frame

5. A belt according to claim 1, wherein said first buckle closure member comprises: (i) laterally compressible mating structure;

(ii) finger grips at lateral margins of said mating structure for manually compressing said compressible mating structure;

(iii) a frame comprising laterally spaced-apart flange members joined at first corresponding ends thereof to a laterally extending frame edge member;

(iv) a yoke laterally extending between and joined to second corresponding ends of said flange members, and joined to said laterally compressible mating structure; and (v) a spindle laterally extending between and secured at opposite ends to the respective flange members.

6. A belt assembly according to claim 5, wherein said second buckle closure member comprises a main body portion defining a cavity for receiving the mating structure of the first buckle closure member when laterally compressed, and lockingly retaining same by means of protrusion elements bounding a mating face of said cavity, said second buckle closure member having at an end thereof opposite said mating face a laterally extending spindle about which said belt may be wrapped.

7. A belt assembly according to claim 6, wherein said first and second buckle closure members are formed of a polymeric material of construction.

8. A method of sizingly adjusting a garment crotch region to the body of a wearer, comprising:

(a) providing a belt assembly according to claim 1;

(b) lockingly mating the first and second buckle closure members of said belt assembly to one another, such that the first loop portion encircles the waist of the wearer and the second loop portion encircles the lower posterior abdomen of the wearer below the first loop portion and defines a posterior extremity of said second loop portion;

(c) passing the posterior extremity of said second loop portion forwardly between the legs of the wearer and frontally upwardly to form a frontal proximal extremity in proximity to the matably locked buckle closure members; and (d) fixably securing said frontal proximal extremity in proximity to the lockingly mated buckle closure members.

9. A method according to claim 8, comprising providing on said second loop portion a hooked fastener longitudinally slidable thereon; providing one of said first and second buckle closure members with an eye element secured thereto, which is matably engageable with said hook element; positioning said hook element at said frontal proximal extremity of the second loop portion of the belt; and engaging said hook element with said eye element.

10. A method of sizingly adjusting a garment crotch region to the body of a wearer, comprising:

(a) providing a belt assembly, comprising:

(i) a first buckle closure member;

(ii) a second buckle closure member matably lockable to said first buckle closure member;

(iii) an elongate belt secured to said first and second buckle closure members so as to form a first loop portion being constructed and arranged so that upon matably locking said first and second buckle closure members to one another at the waist of a wearer, the first loop portion encircles the waist of the wearer and the second loop portion encircles the lower posterior abdomen of the wearer below the first loop portion and reentrantly passes forwardly between the legs and frontally upwardly to a frontal proximal extremity in proximity to the matably locked buckle closure members; and (iv) means for fixably securing said frontal proximal extremity in proximity to said matably locked first and second buckle closure members;

(b) lockingly mating the first and second buckle closure members of said belt assembly to one another, such that the first loop portion encircles the waist of the wearer and the second loop portion encircles the lower posterior abdomen of the wearer below the first loop portion and defines a posterior extremity of said second loop portion;

(c) passing the posterior extremity of said second loop portion forwardly between the legs of the wearer and frontally upwardly to form a frontal proximal extremity in proximity to the matably locked buckle closure member;

(d) fixably securing said frontal proximal extremity in proximity to the lockingly mated buckle closure members; and (e) wherein said frontal proximal extremity of said second loop portion of the belt is formed into a frontal loop, and a frontal segment of the first loop portion is passed through said frontal loop.

11. A method according to claim 10, comprising providing on said second loop portion a hooked fastener longitudinally slidable thereon; providing one of said first and second buckle closure members with an eye element secured thereto, which is matably engageable with said hook element; positioning said hook element at said frontal proximal extremity of the second loop portion of the belt; and engaging said hook element with said eye element.

12. A belt assembly for adjusting fit of a garment in the crotch region thereof, said belt assembly comprising:

(a) a first buckle closure member;

(b) a second buckle closure member matably lockable to said first buckle closure member;

(c) an elongate belt secured to said first and second buckle closure members so as to form a first loop portion being constructed and arranged so that upon matably locking said first and second buckle closure members to one another at the waist of a wearer, the first loop portion encircles the waist of the wearer and the second loop portion encircles the lower posterior abdomen of the wearer below the first loop portion and reentrantly passes forwardly between the legs and frontally upwardly to a frontal proximal extremity in proximity to the matably locked buckle closure members;

(d) means for fixedly securing said frontal proximal extremity in proximity to said metably locked first and second buckle closure members; and (e) said frontal proximal extremity of said second loop portion of the belt being formed into a frontal loop, and a frontal segment of the first loop portion being passed through said frontal loop.

* * * * *